US006572402B2

(12) United States Patent
Lin

(10) Patent No.: US 6,572,402 B2
(45) Date of Patent: Jun. 3, 2003

(54) STATUS DISPLAY ELECTRIC SIGNAL PLUG

(75) Inventor: Shien-Chang Lin, Taipei (TW)

(73) Assignee: North Star Systems Corp., Taipei (TW)

( * ) Notice: Subject to any disclaimer, the term of this patent is extended or adjusted under 35 U.S.C. 154(b) by 0 days.

(21) Appl. No.: 09/952,969

(22) Filed: Sep. 17, 2001

(65) Prior Publication Data

US 2003/0054698 A1 Mar. 20, 2003

(51) Int. Cl.[7] ..... H01R 3/00
(52) U.S. Cl. ..... 439/490; 439/668
(58) Field of Search ..... 439/668, 490, 439/669; 340/654, 656

(56) References Cited

U.S. PATENT DOCUMENTS 5,244,409 A * 9/1993 Guss et al. ..... 439/490
5,964,616 A * 10/1999 Eisenbraun ..... 439/490

* cited by examiner

*Primary Examiner*—Lynn Field
*Assistant Examiner*—Hae Moon Hyeon
(74) *Attorney, Agent, or Firm*—Troxell Law Office PLLC

(57) ABSTRACT

The present invention relates to an electric signal plug with status display, including a plug that connects to an electric cable at one end for linking to the electric signal source; the above-described plug can detect and display electric signal strength by connecting a circuit detector equipped with an IC detector and at least one display component to the electric cable, moreover the formation of a display ring from the internal tube and outer case directly reveal to the outside the strength of the electric signal inside the electric cable.

7 Claims, 6 Drawing Sheets

STATUS DISPLAY ELECTRIC SIGNAL PLUG

BACKGROUND OF THE INVENTION

1. Field of the Invention

The present invention relates to a status display electric signal plug, and specifically a plug structure used with electric signal connections and possessing external ring components pervious to light that directly display the strength of electric signals.

2. Description of the Prior Art

Electric signal plugs are widely used in electric signal connections, such as for linking signal sources with all kinds of electric/electronic equipment so that signal sources can directly supply the needed electric signal to electric/electronic equipment. Therefore it is necessary to confirm electric signal strength levels in order to maintain circuit free flow. Nevertheless, in actual situations where electric signal plugs are applied to connect signal source and electric/electronic equipment, it leads to a situation where the electric signal must take an extremely long transmission route because of the connection of the electric signal plug and signal source by an electric cable, thereby creating problems such as transmission failures to the electric/electronic equipment, breaks in signal transmission, or large amounts of damaged signals due to disturbance, route break malfunction, or signal source malfunction.

Also, the electric signal transmitted by the electric signal plug is usually related to voltage, current, or frequency changes. For example, the electric signal plug power source types commonly used to provide direct current power source to electric/electronic equipment are totally unable to concisely and immediately display status detection results for voltage or current changes in electric cords. If a voltage meter or current meter must be used to measure electric signals in the electric cord then the electric signal plug must be temporarily disconnected from the electric/electronic equipment and this leads to having to temporarily stop using the equipment as well as inconvenient detecting and inspection steps. Also, there are problems we cannot easily or lightly ignore stemming from voltage deficiency, current deficiency, or even breaks in the line or signal transmission inside the electric cable that leads to other malfunction situations and makes it further impossible to use the naked eye to directly obtain observation results; while having to judge by the situation of end equipment performance makes it even more impossible to immediately understand electric signal transmission malfunction circumstances and greatly affects electric/electronic equipment performance.

SUMMARY OF THE INVENTION

The primary objective of the present invention is to provide a status display electric signal plug possessing an electric signal strength detector and circuit display able to directly and immediately display electric signal strengths. Another objective of the present invention is to provide a status display electric signal plug possessing an exterior radiating ring that displays electric signal strength and is able to display the conditions of signal strength detection in a manner observable by the naked eye.

In order to accomplish the above-described objective, the present electric signal plug invention includes a plug that connects to an electric cable at one end for linking to the electric signal source; the above-described plug can detect and display electric signal strength by connecting a circuit detector equipped with an integrated circuit (IC) detector and at least one display component to the electric cable, in order to detect and display electric signal strength. Moreover, the plug itself also is enclosed with an internal tube and outer case as well as a light conducting tube installed between the internal tube and outer case with a display ring exposed at its top and a plurality of half-circle shaped indentations at its bottom to avoid contact with the circuit detector display components and welded points, acting to diffuse and guide the flashing light from the display component to the display ring thereby revealing electric signal strength and status through the display ring.

Structural details and application of the present invention will be made clear by the details in the explanation to follow. At the same time an elaboration of the structure are presented in the detailed description of the preferred embodiments below and preceded by the brief description of the drawings to provide a further understanding of technological content of the invention herein.

DETAILED DESCRIPTION OF THE PREFERRED EMBODIMENTS

Figure 1:
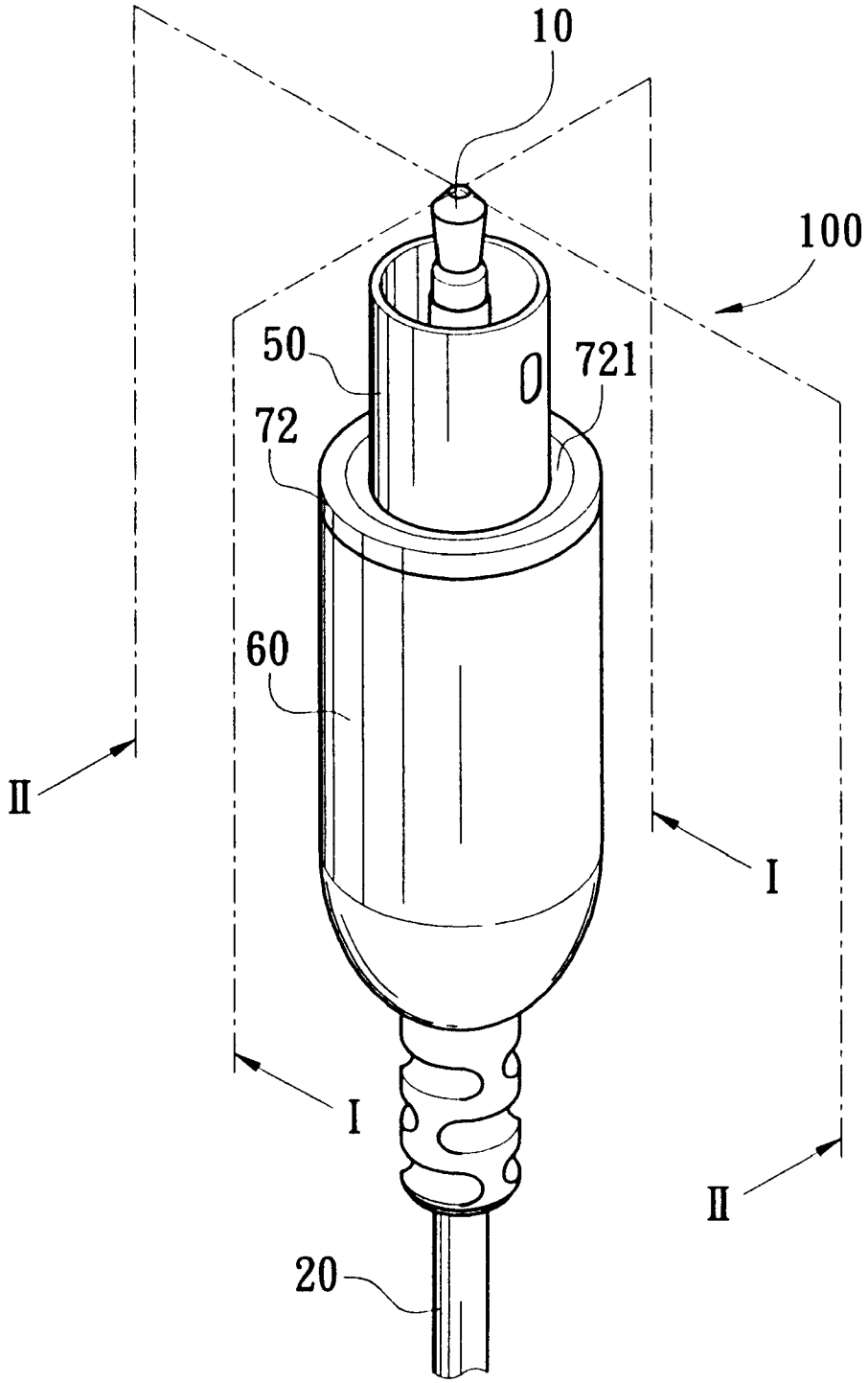
FIG. 1 is a perspective view of the present invention's external structure.
Figure 2:
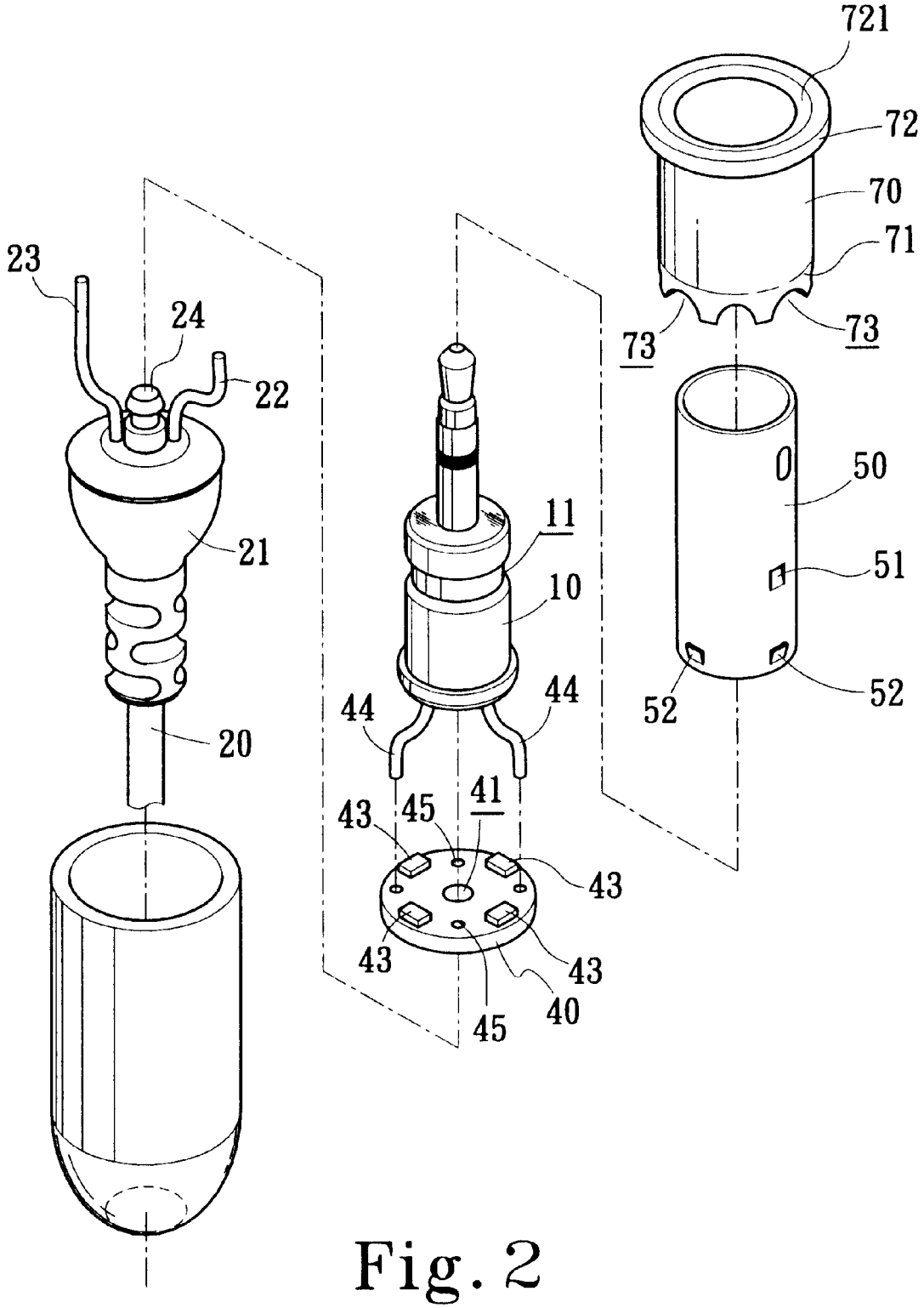
FIG. 2 is a perspective exploded view showing the structure of the present invention.
Figure 3:
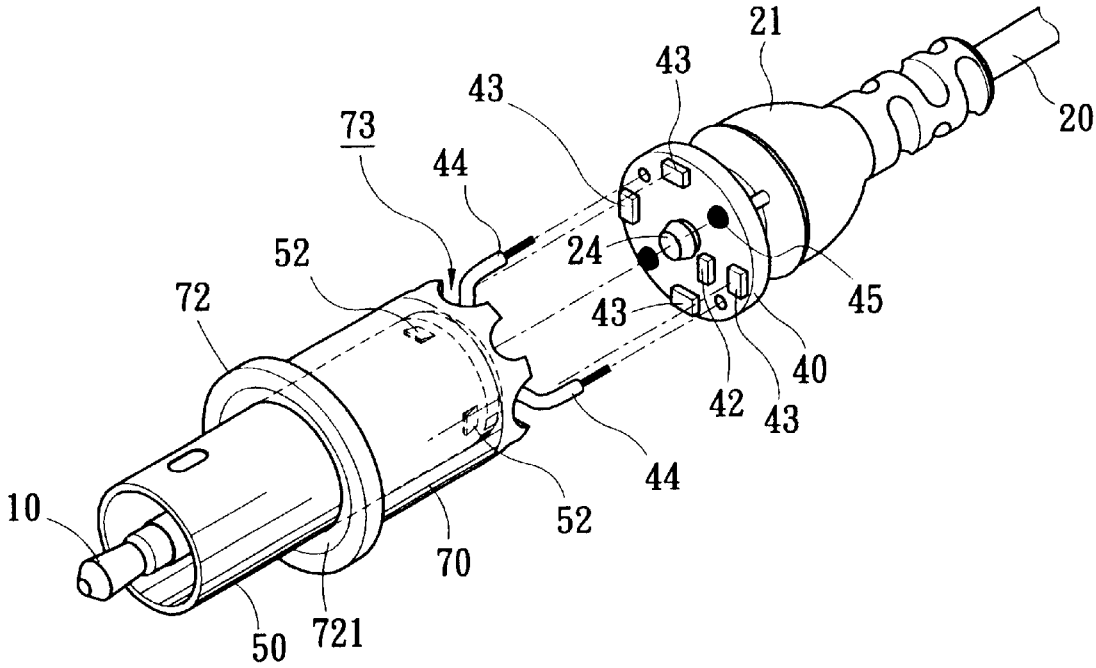
FIG. 3 is an exploded view similar to FIG. 2, but shows the structure of how the circuit detector and electric cable connect inside the plug.
Figure 4:
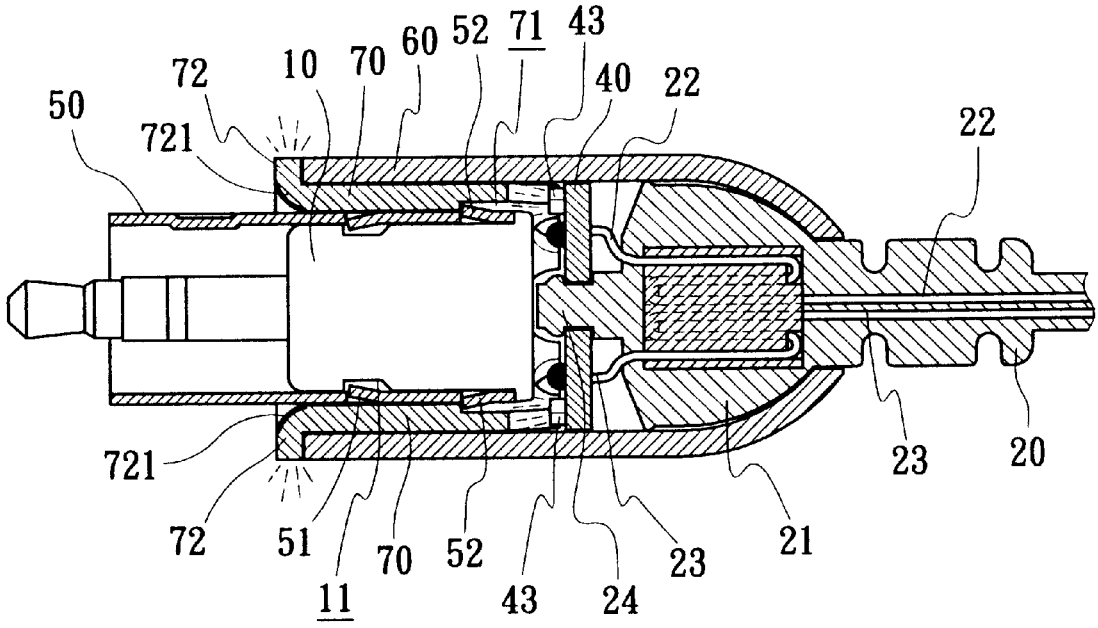
FIG. 4 is a cross-sectional view taken along line I—I of FIG. 1 showing the situation where the half-circle shaped indentations at the bottom of the light conducting tube avoid contact with the circuit detector welding points.
Figure 5:
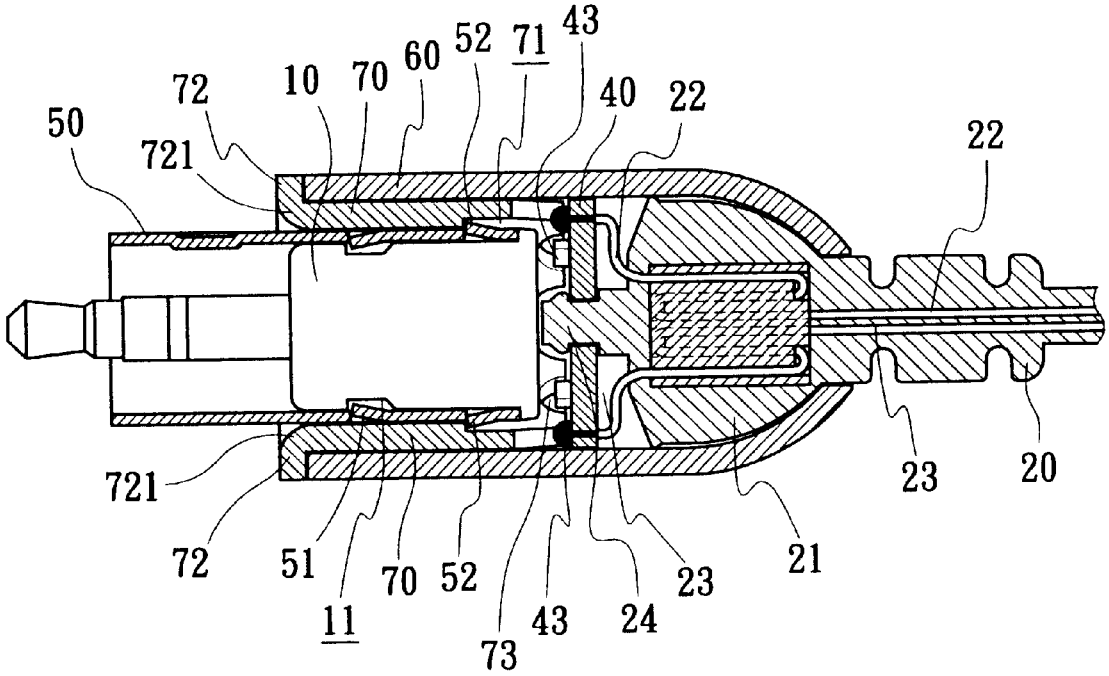
FIG. 5 is a cross-sectional view taken along line II—II of FIG. 1 showing the situation where the half-circle shaped indentations at the bottom of the light conducting tube avoid contact with the circuit detector display components.

First look at FIGS. 1 through 3 and notice that the present electric signal plug invention is displayed as unit 100 in all of the following Figures. However plug unit 100 shall not be limited in shape or form. The present invention uses a direct power source connection model as an example. Plug unit 100 includes: a plug 10 utilizing direct current connection model as described above, electric cable 20 to link with the electric signal source. The example made in the present invention is used to supply direct current to equipment that includes an insulation encasement 21 at the end of the electric cable 20 (as shown in FIGS. 1, 2, 3) to act as a bridge inside the plug 10.

Conducting wires 22 and 23 of the above described electric cable 20 pass through the top part of insulation encasement 21 to provide electric signal from said signal source (direct current supply equipment). At the top part of insulation encasement 21 is installed a protruded area 24 acting to fasten circuit detector 40 in place. The shape or form of circuit detector 40 is not limited in form, and in the present invention has a disk design with opening 41 designed in the center to allow it to be fixed within protrusion 24. Other circuit detector forms and fixation methods shall remain within the scope of the present invention.

IC detector 42 and a plurality of display components 43 are included on circuit detector 40. IC detector 42 connects to conductor wires 22 and 23 to test the strength of the electric signal. The scope of signal strength testing includes the testing of components such as voltage, currency, frequency, etc, while display component 43 uses different colored lights to show signal strength. For example the present invention's direct current model use a green light to show normal voltage and currency and an orange light to show irregular voltage or current. Moreover, different colored light signals can be shown by a single display component 43 or a combination of multiple display components 43, of which the form of component 43 shall not be limited, while the present invention uses Light Emitting Diode (LED) as a explanation demonstration. The above described circuit detector 40 forms a connection with plug 10 through conductor wires 44 in order to again transfer electric signal to plug 10.

The circuit connection process of above described IC detector 42 and display components 43 on circuit detector 40 must be completed by a plurality of soldering points 45, which are individually located spread out on the top and bottom sides of circuit detector 40.

In regard to present invention electric signal plug unit 100 described above there is included internal tube 50 and outer cover 60 encases plug 10. Inside on plug 10 is circumferential indentation 11 as well as a plurality of indented slips 51 and protruding clips 52 on internal tube 50. Indented clips 51 match up with circumferential indentation 11 to fix plug 10 and internal tube 50 into one piece, while outer cover 60 is used to encase part of the insulated area 21 of electric cable 20 and internal tube 50. Internal tube 50 and plug 10 protrude from outer case 60 and are used to connect to the corresponding socket of electric/electronic equipment (not shown in the accompanying Figures).

Figure 6:
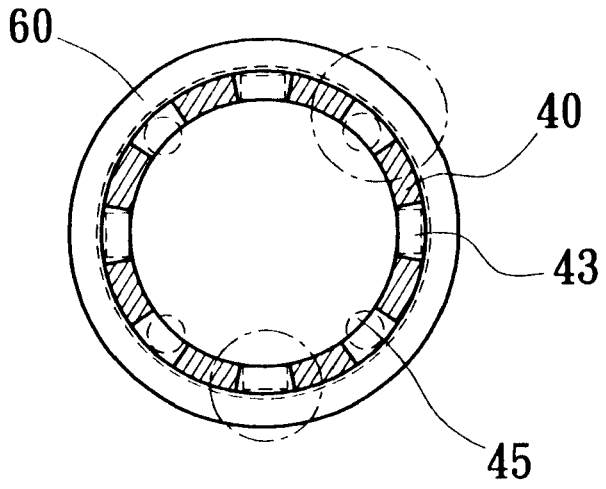
FIG. 6 is a perspective top view showing the correlating relationship between the half-circle shaped indentations at the bottom of the light conducting tube and the circuit detector display components and welding points.
Figure 7:
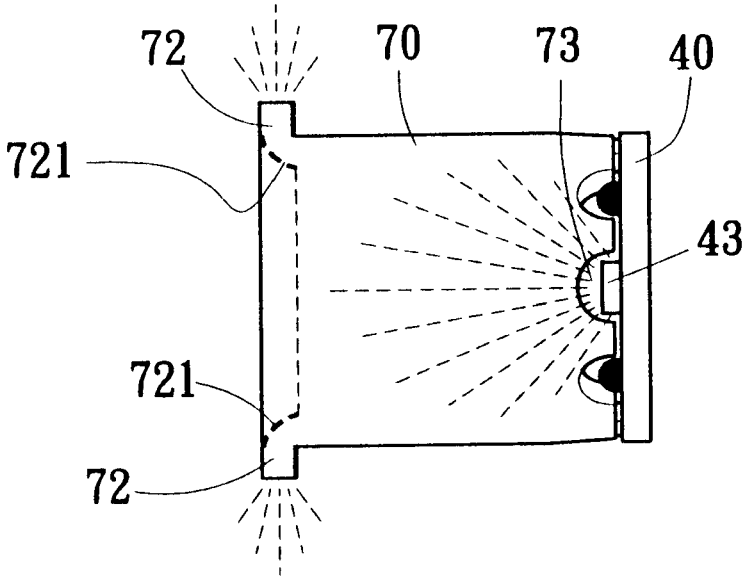
FIG. 7 is a perspective partial enlarged view showing how the flashing light from circuit detector display components is expanded and conducted into the display ring through the light conduction tube.

The form of conduction tube 70 shall not be limited, and can be made from any light conducting transparent or non-transparent tube component structure, fitting beneath said internal tube 50 and outer case 60, into which are indentations 71 (see FIGS. 6 and 7) matching up with protruding clips 52 on said internal tube 50, thereby fixing outer case 60 and internal tube 50 tightly together with light conductor tube 70. On the top outer border of light conductor tube 70 is installed a display ring 72, which has a mouth larger than the mouth of light conductor tube 70, which protrudes out beyond outer case 60. On the inside of this ring is side 721, which is covered with reflecting or refracting material.

Now please correlate with FIGS. 4, 5, 6, and 7 to see half-circle shaped indentations 73 on the bottom of said light conductor tube 70, which fit around each display component 43 and soldering point 45 located on the circuit detector 40 (see FIGS. 4, 5, 6), thereby ensuring that the bottom of light conductor tube 70 does not touch display components 43 and soldering points 45. This also allows half-circle shaped indentations 73 to act as concave lenses diffusing and guiding the light rays emitted by display component 43 and transmitting them through light conducting tube 70 to display ring 72 at the top end. During this transmission process the reflecting or refracting material applied to inner ring 721 it causes light to reflect or refract 90 degrees thereby expanding light into the entirety of display ring 72 (see FIG. 7) and displaying such results on the surface of display ring 72 so that such results correlate exactly with the colors flashed by circuit detector 40 when it releases signal source electric signal testing results. Thus by looking at the exterior of signal plug 100 the naked eye can directly observe and identify the strength and condition of the electric signal being transferred inside the plug. Moreover, according to the detailed structure, capability, and operation explanation of the present electric signal plug invention as described above in FIGS. 1~7, we discover the following conclusions about its advantages, practical uses, and valuable industrial applications as follows.

1. Possesses automatic electric signal strength testing capability through the direct testing of the electric signal by circuit detector 40 and display of the results by display component 43. By now combining this with the conduction and display of flashing from display component 43 though display ring 72 and conductor tube 70, the user is now able to clearly observe the strength and condition of the electric signal directly with the human eye and without any need for additional apparatus.
2. Possesses simple and direct clear display capability results. Through a structure causing flashing from display component 43 to be conducted and displayed through display ring 72 and conductor tube 70, the user does not need to use additional apparatus to be able to clearly observe the strength and condition of the electric signal directly with the human eye.

The present invention is an electric signal plug with status display, the essence of which lies in the most streamlined composition of components resulting in the electric signal plug possessing direct electric signal strength and status display capabilities, further making it the only such superior invention with industrial application value.

As shown above in FIGS. 1~7, the present invention is an electric signal plug with status display and all related explanations, content, and diagrams, are for the purpose of explaining the technology and means used by the present invention, and the scope of the present invention is not limited to the practical application example contained therein. Moreover, all structural embellishments and/or component replacements in relation to the present invention are included within the parameters and essence of the present invention, which parameters shall be established by the following patent parameters.

What is claimed is:

1. An electric signal plug comprising:

a plug with one end configured to connect to a corresponding electric/electronic equipment socket;

an internal tube encasing the plug;

an outer cover encasing the internal tube;

an electric cable with one end connecting to an electric signal source, and another end equipped with an insulation encasement enclosed by the outer cover, the electric cable having two conductor lines extending out of the insulation case to transmit an electric signal;

a circuit detector fixed in place on the electric cable insulation encasement and connecting to the electric cable conductor lines to receive electric signals, the circuit detector having an integrated circuit (IC) detector and at least one display component to detect and display electric signal strength; and, a light conductor tube fitted between the internal tube and the outer cover having a top with a display ring that is exposed outside of the outer cover and a bottom with a plurality of half-circle shaped indentations that match up with and avoid the at least one display component and welding points on the circuit detector so as to diffuse and guide flashing light from the at least one display component to the display ring thereby revealing electric signal strength and status at the display ring.

2. The electric signal plug according to claim 1, wherein, a circumferential indentation on the plug is engaged by a plurality of indented clips on the internal tube to tightly fix the internal tube to the plug.

3. The electric signal plug according to claim 1, wherein, a protruding clip on the top end of the insulation case engages a center hole in the circuit detector to allow the circuit detector to fit over the protruding clip.

4. The electric signal plug according to claim 1, wherein, the plug and the circuit detector are connected by a pair of conductor lines.

5. The electric signal plug according to claim 1, wherein, the at least one display component in the circuit detector is a Light Emitting Diode (LED).

6. The electric signal plug according to claim 1, wherein, a plurality of protruding clips on an exterior of the interior tube engage indentations on an inside of the light conductor tube allowing the inner tube and connector tube to fit tightly together.

7. The electric signal plug according to claim 1, wherein, a reflecting and refracting material applied to an inner ring of the display ring on the light conduction tube cause the light to reflect and refract 90 degrees.

* * * * *